United States Patent [19]

Herbert et al.

[11] Patent Number: 4,887,805

[45] Date of Patent: Dec. 19, 1989

[54] TOP VACUUM CORRUGATION FEEDER

[75] Inventors: Glenn M. Herbert, Rochester; Charles S. Kneisel, Farmington; Russell McDonald, Rochester; Raymond A. Povio, Pittsford; Michele D. Zirilli, Walworth, all of N.Y.

[73] Assignee: Xerox Corporation, Stamford, Conn.

[21] Appl. No.: 166,281

[22] Filed: Mar. 10, 1988

[51] Int. Cl.[4] ..... B65H 3/12

[52] U.S. Cl. ..... 271/94; 271/98; 271/208; 271/34

[58] Field of Search ..... 271/34, 98, 94, 96, 271/105, 208

[56] References Cited

U.S. PATENT DOCUMENTS

| | | | |
|---|---|---|---|
| 868,317 | 10/1907 | Allen . | |
| 1,721,608 | 7/1929 | Swart et al. . | |
| 1,867,038 | 7/1932 | Upham . | |
| 2,224,802 | 12/1940 | Spiess . | |
| 2,594,373 | 4/1952 | Watson | 271/105 |
| 2,895,552 | 7/1959 | Pomper et al. | 164/68 |
| 2,979,329 | 4/1961 | Cunningham | 271/29 |
| 3,031,067 | 6/1962 | Fux et al. | 271/27 |
| 3,086,771 | 4/1963 | Goin et al. | 271/31 |
| 3,171,647 | 3/1965 | Bishop | 271/11 |
| 3,182,988 | 5/1965 | Peterson | 271/74 |
| 3,260,520 | 7/1966 | Sugden | 271/26 |
| 3,424,453 | 1/1969 | Halbert | 271/35 |
| 3,614,089 | 10/1971 | Van Auken et al. | 271/26 R |
| 3,770,266 | 11/1973 | Wehr et al. | 271/97 |
| 3,837,639 | 9/1974 | Phillips | 271/105 |
| 3,861,668 | 1/1975 | Wood | 271/105 |
| 4,157,177 | 6/1979 | Strecker | 271/197 |
| 4,268,025 | 5/1981 | Murayoshi | 271/112 |
| 4,269,406 | 5/1981 | Hamlin | 271/108 |
| 4,306,684 | 12/1981 | Peterson | 239/597 |
| 4,382,593 | 5/1983 | Beran et al. | 271/12 |
| 4,397,459 | 8/1983 | Silverberg | 271/105 X |
| 4,418,905 | 12/1983 | Garavuso | 271/98 |
| 4,451,028 | 5/1984 | Holmes et al. | 271/11 |
| 4,589,647 | 5/1986 | Roller | 271/94 |
| 4,596,385 | 6/1986 | Silverberg | 271/98 X |
| 4,627,605 | 12/1986 | Roller | 271/94 |
| 4,635,921 | 1/1987 | Thomas | 271/94 |
| 4,699,369 | 10/1987 | Zirilli | 271/94 |

*Primary Examiner*—Richard A. Schacher

[57] ABSTRACT

A top vacuum corrugation feeder employs a vacuum feedhead working in conjunction with an air knife to feed sheets from the top of a stack. The feedhead is valveless and has a vacuum applied thereto during the entire feed cycle in order to increase reliability and decrease minimum feed speed. The air knife includes trapezoidal shaped fluffer jets in front of the stack and side fluffer jets and added on the sides of the stack in order to assist the feedhead in separating severely downcurled sheets for feeding. A rotational damper member is positioned above and has a portion thereof resting on the stack for controlling sheet flutter and leakage of air from the stack sides. A belt coast control member controls the precise stopping position of vacuum belts that surround the vacuum feedhead in order to minimize multifeeding of sheets from the stack.

4 Claims, 6 Drawing Sheets

TOP VACUUM CORRUGATION FEEDER

Hereby cross-reference, and incorporated by reference, is the copending application of the same assignee, U.S. Ser. No. 098,096, entitled "Improved Copying System For On-Line Finishing" by James E. Britt et al., filed Sept. 17, 1987.

This invention relates to an electrophotographic printing machine, and more particularly, concerns an improved top vacuum corrugation feeder for such a machine.

Present high speed xerographic copy reproduction machines and printers produce copies at a rate in excess of several thousand copies per hour, therefore, the need for a sheet feeder to feed cut copy sheets to the machine in a rapid-dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also be utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smeared through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

In addition, currently existing paper feeders, e.g., forward buckle, reverse buckle, corrugating roll, etc., are very sensitive to coefficients of friction of component materials and to sheet material properties as a whole.

One of the sheet feeders best known for high speed operation is the top vacuum corrugation feeder with a front air knife. In this system, a vacuum plenum with a plurality of friction belts arranged to run over the vacuum plenum is placed at the top of a stack of sheets in a supply tray. At the front of the stack, an air knife is used to inject air into the stack to raise the top several sheets from the remainder of the stack. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially and therefore the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets. Also, some current top and bottom vacuum corrugation feeders utilize a valved vacuum feedhead, e.g., U.S. Pat. No. 4,269,406 which is included herein by reference. At the appropriate time during the feed cycle the valve is actuated, establishing a flow and hence a negative pressure field over the stack top or bottom if a bottom vacuum corrugation feeder is employed. This field causes the movement of the top sheet(s) to the vacuum feedhead where the sheet is then transported to the takeaway rolls. Once the sheet feed edge is under control of the takeaway rolls, the vacuum is shut off. The trail edge of this sheet exiting the feedhead area is the criteria for again activating the vacuum valve for the next feeding.

From a prior standpoint, U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an air blast is directed to the leading edge of a stack of sheets from which the sheet is to be separated and fed to assist in separating the sheets from the stack.

U.S. Pat. No. 2,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of the sheet and release the sheet over the pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

U.S. Pat. No. 4,418,905 (Garavuso) shows a bottom vacuum corrugation feeding system.

U.S. Pat. No. 4,451,028 (Holmes et al.) discloses a top feed vacuum corrugation feeding system that employs front and back vacuum plenums.

U.S. Pat. Nos. 868,317 (Allen); 1,721,608 (Swart et al.); 1,867,038 (Uphan); 2,224,802 (Spiess); 3,041,067 (Fux et al.); 3,086,771 (Goin et al.); 3,770,266 (Wehr et al.); and 4,328,593 (Beran et al.); all disclose sheet feeders in which a blower appears to be angled at sheets.

U.S. Pat. No. 3,182,998 (Peterson) is directed to a conveyor device that includes a belt comprising diamond shaped rubber suction cups.

U.S. Pat. Nos. 3,837,639 (Phillips) and 4,306,684 (Peterson) relate to the use of air nozzles to either separate or maintain sheet separation.

U.S. Pat. No. 3,171,647 (Bishop) describes a suction feed mechanism for cardboard and like blanks that employs a belt which is intermittently driven.

U.S. Pat. No. 3,260,520 (Sugden) is directed to a document handling apparatus that employs a vacuum feed system and a vacuum reverse feed belt adapted to separate doublets.

U.S. Pat. No. 3,614,089 (Van Auken) relates to an automatic document feeder that includes blowers to raise a document up against feed belts for forward transport. Stripper wheels are positioned below the feed belts and adapted to bear against the lower surface of the lowermost document and force it back into the document stack.

U.S. Pat. No. 4,294,539 (Spehrley, Jr.) discloses a document handling system that in FIGS. 5 and 6 shows a single large apetured vacuum belt having smooth grooves for optical uniformity as well as air flow uniformity.

U.S. Pat. No. 4,589,647 (Roller) discloses a top vacuum corrugation feeder that employs a valveless feedhead.

U.S. Pat. No. 4,627,605 (Roller et al.) discloses a top vacuum corrugation feeder that includes an air knife with fluffer jets and vectored auxiliary fluffer jets in order to assist in separating severely downcurled sheets for feeding. Knurled vacuum feed belts are included in order to provide a uniform negative pressure to sheet material once a sheet is acquired by a vacuum plenum around which the belts are mounted.

U.S. Pat. No. 4,635,921 (Thomas) discloses a top vacuum corrugation feeder that includes an air knife with fluffer jets and vectored auxiliary fluffer jets in order to assist in separating severely downcurled sheets for feeding.

U.S. Pat. No. 4,699,369 (Zirilli) discloses a top vacuum corrugation feeder having an air knife that includes a pair of trapezoidal shaped fluffer jets.

IBM Technical Disclosure Bulletin entitled "Document Feeder and Separator", Vol. 6, No. 2, page 32, 1963 discloses a perforated belt that has a vacuum applied through the perforations in the belt in order to lift documents from a stack for transport. The belt extends over the center of the document stack.

The above-mentioned disclosures are included herein by reference to the extent necessary to practice the present invention.

It is an object of the present invention to provide an improved sheet separator feeder capable of feeding sheets at a rate of 135–150 copies per minute.

It is an additional object of the present invention to provide an improved sheet feeder that is independent of sheet material properties.

It is a further object of the present invention to provide a sheet separator feeder that has a longer lasting high quality field performance.

It is yet another object of the present invention to provide critical enablers to the fluffing of sheets in a sheet separator feeder in order to improve the feeding of downcurled, stiff sheets.

It is an additional object of the present invention to provide a sheet separator feeder with an improved vacuum feed mechanism belt that enhances sheet acquisition by effectively enlarging the vacuum area, and thereby also increasing the sheet drive out force of the feed belt.

These and other objects are attained with a top sheet feeding apparatus comprising a sheet stack support tray, feedhead means including a vacuum plenum chamber positioned over the front of a stack of sheets when sheets are placed in the tray with the vacuum plenum chamber having a negative pressure applied thereto at all times during a feed cycle, said vacuum plenum chamber having a sheet corrugation means mounted in the center of its bottom surface and perforated knurled feed belts associated with said vacuum plenum chamber to transport the sheets acquired by said vacuum plenum chamber in a forward direction out of the stack support tray; air knife means positioned immediately adjacent the front of said stack of sheets for applying a positive pressure to the sheet stack in order to lift and separate the upper-most sheet from the rest of the stack, said air knife means including side stack fluffer jets, trapezoidal shaped pre-separation fluffer jets, converging slot jets, and fang gate means adapted to prevent multifeeding of sheets; and rotational damper means for controlling leakage from the stack sides in order to minimize sheet flutter and improve curled sheet feeding.

For a better understanding of the invention as well as other objects and further features thereof, reference is made to the following drawings and descriptions.

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
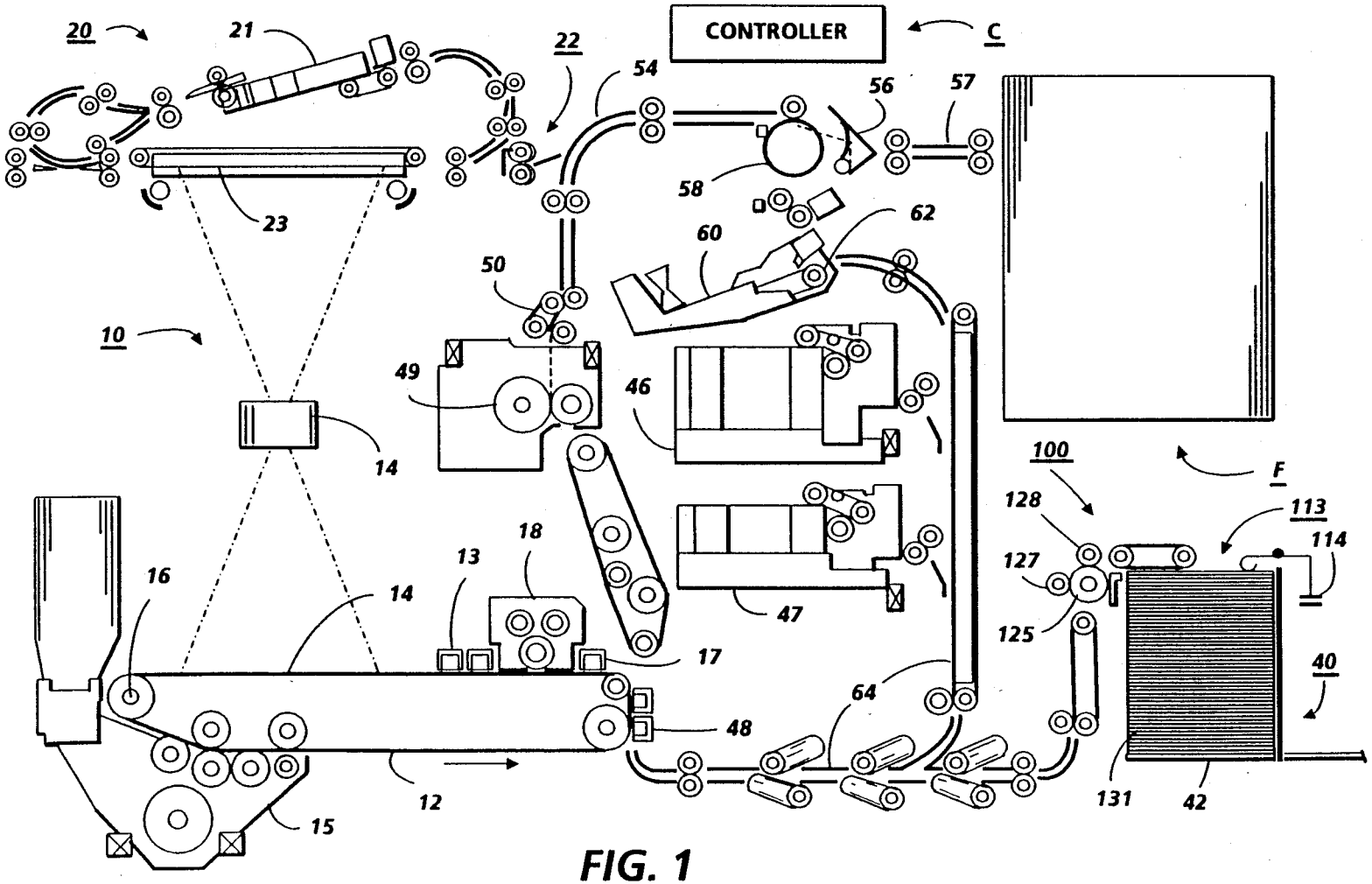
FIG. 1 is a schematic elevational view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in nonxerographic environments and substrate transportation is general.

Inasmuch as the art of electrophotographic printing is well known, the various processing stations employed in the FIG. 1 printing machine will be shown hereinafter schematically and the operation described briefly with reference thereto.

The exemplary copier 10 of FIG. 1 will now be briefly described. The copier 10 conventionally includes a xerographic photoreceptor belt 12 and the xerographic stations acting thereon for respectively corona charging 13, image exposing 14, image developing 15, belt driving 16, precleaning discharge 17 and toner cleaning 18. Documents on the platen 23 maybe imaged onto the photoreceptor 12 through a variable reduction ratio optical imaging system to fit the document images to the selected size of copy sheets.

The control of all machine functions, including all sheet feeding, is, conventionally, by the machine controller "C". The controller "C" is preferably a known programmable microprocessor, exemplified by the microprocessor disclosed in U.S. Pat. No. 4,166,558. The controller "C" conventionally controls all of the machine steps and functions described herein, and others, including the operation of the document feeder 20, all the document and copy sheet deflectors or gates, the sheet feeder drives, the finisher "F", etc. The copier controller also conventionally provides for storage and comparison of the counts of the copy sheets, the number of documents recirculated in a document set, the desired number of copy sets and other selections and contols by the operator through the console or other panel of switches connected to the controller, etc. The controller is also programmed for time delays, jam correction control, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

The copier 10 is adapted to provide either duplex or simplex precollated copy sets from either duplex or simplex original documents presented by the RDH 20. Two separate copy sheet trays 46 and 47 and a multiream feeder apparatus 100 are provided for feeding clean copy sheets from either one selectably. The may be referred to as the main tray 46, auxiliary tray 47 and high capacity feeder 100.

The copy sheets are fed from the selected one of the trays 46, 47 or 100 to the transfer station 48 for the conventional transfer of the xerographic toner image of document images from the photoreceptor 12 to the first side of a copy sheet. The copy sheets are then fed by a vacuum transport to a roll fuser 49 for the fusing of that toner image thereon. From the fuser, the copy sheets are fed through a sheet decurler 50. The copy sheets then turn a 90° corner path 54 in the sheet path which inverts the copy sheets into a last-printed face-up orientation before reaching a pivotal decision gate 56. The image side which has just been transferred and fused is face-up at this point. If this gate 56 is down it passes the sheets directly on without inversion into the output path 57 of the copier to the finishing module "F". If gate 56 is up it deflects the sheets into a duplex inverting transport 58. The inverting transport (roller) 58 inverts and then stacks copy sheets to be duplexed in a duplex buffer tray 60.

The duplex tray 60 provide intermediate or buffer storage for those copy sheets which have been printed on one side and on which it is desired to subsequently print an image or images on the opposite side thereof, i.e. copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (blank) sheets from the trays 46, 47 or 100. It may be seen that this copy sheet feed path 64 between the duplex tray 60 and the transfer station 48 has an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 and fed out into the output path 57.

The output path 57 here transports the printed copy sheets directly, one at a time, into the connecting, online, modular, finishing station module "F". There the completed precollated copy sets may be finished by stapling, stitching, gluing, binding, and/or offset stacking. Suitable details are disclosed in the cited art, or other art, or in the applications cross-referenced hereinabove.

It is believed that the foregoing description is sufficient to illustrate the general operation of an electrostatographic machine.

Figure 2:
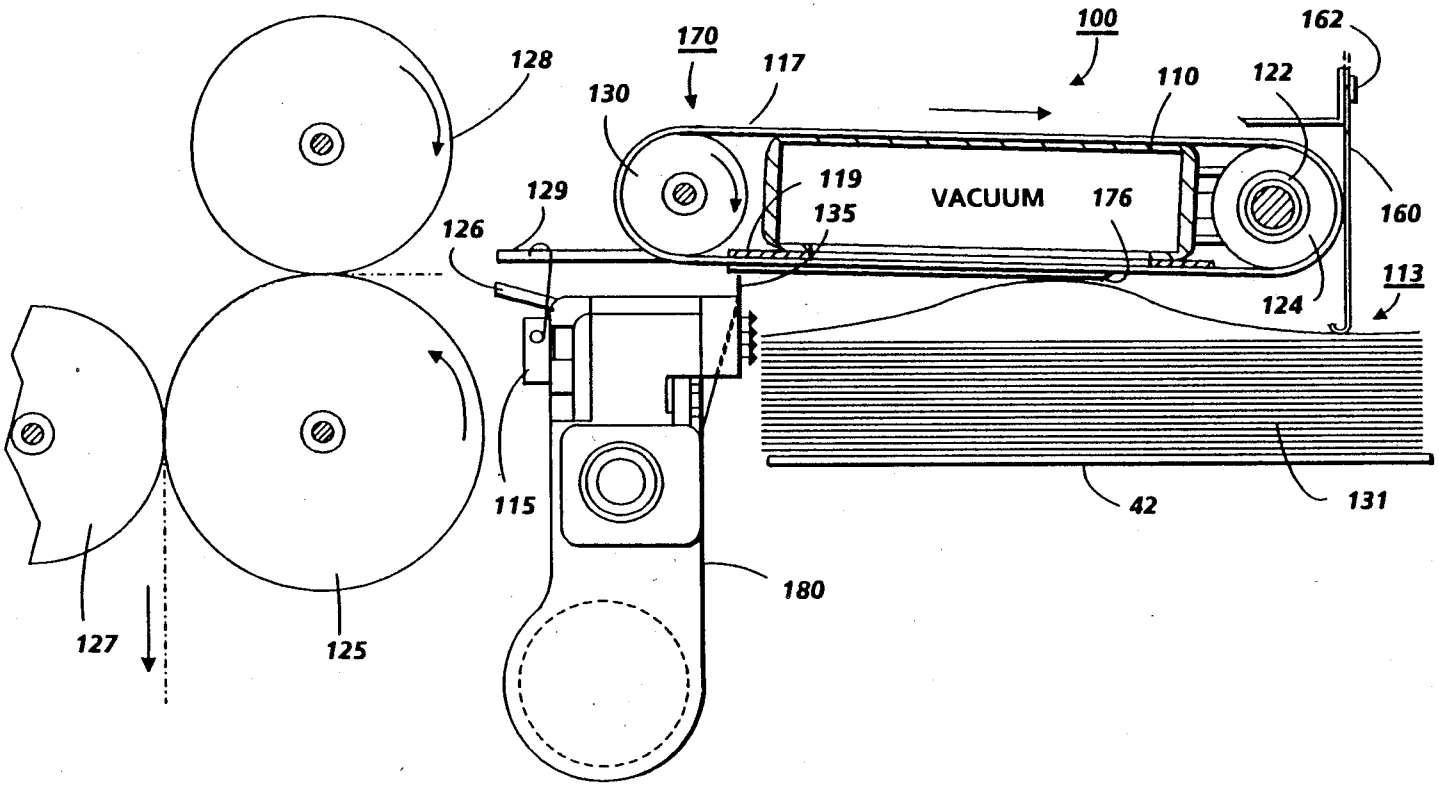
FIG. 2 is an enlarged partial cross-sectional view of the exemplary feeder in FIG. 1 which is employed in accordance with the present invention.
Figure 3:
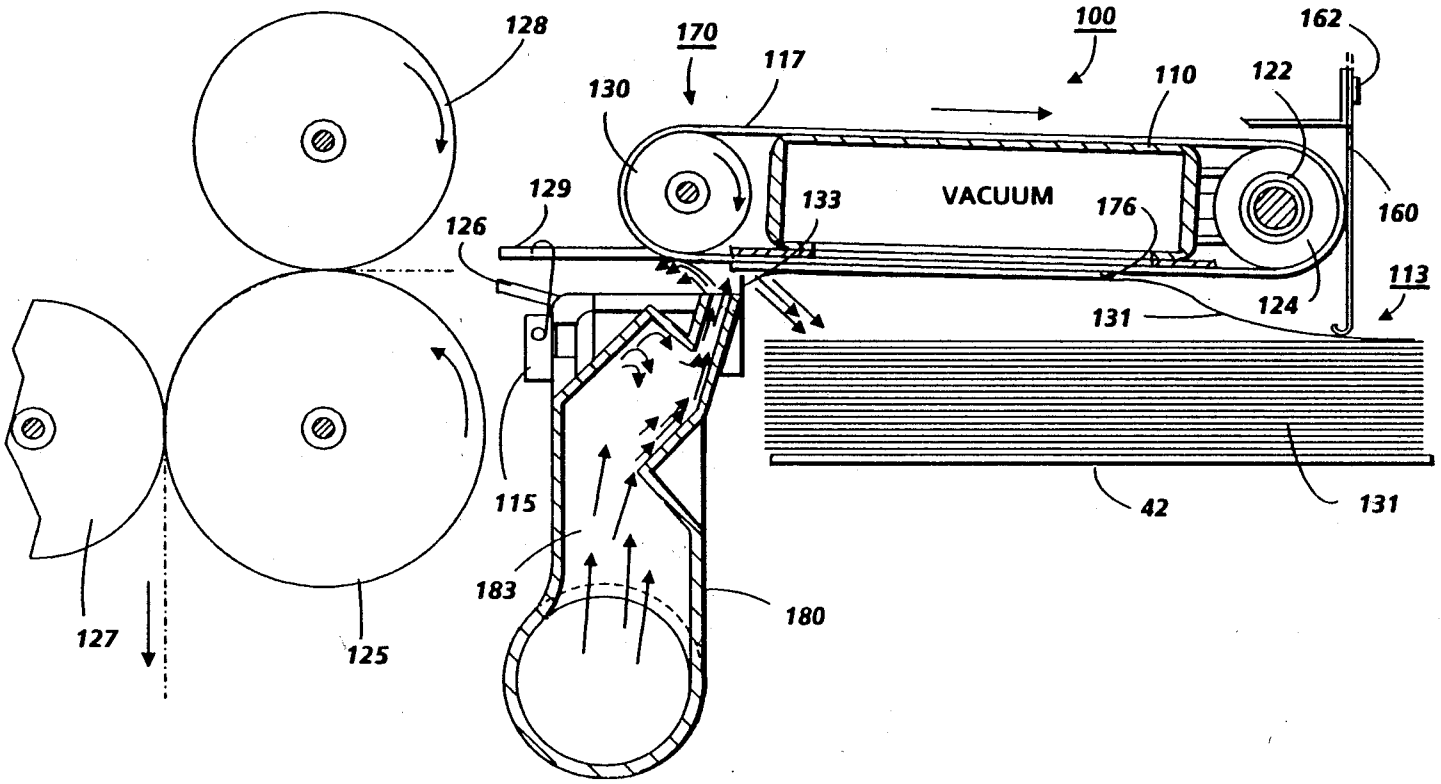
FIG. 3 is a partial front end view of the feeder shown in FIG. 2 with arrows indication the direction and path of air knife pressure flow.

Referring now to a particular aspect of the present invention, FIGS. 2 and 3 show a system employing the high capacity feeder 100 of the present invention in a copy sheet feeding mode. Alternatively or in addition, the sheet feeder may be mounted for feeding document sheets to the platen of a printing machine. The sheet feeder 100 is provided with a conventional elevator mechanism (not shown) for raising and lowering either tray 40 or platform 42. Ordinarily, a drive motor is actuated to move the sheet stack support platform 42 vertically by a stack height sensor 114 positioned above the rear of the stack when the level of sheets relative to the sensor falls below a first predetermined level. The drive motor is deactuated by the stack height sensor when the level of the sheets relative to the sensor is above a predetermined level. In this way, the level of the top sheet in the stack of sheets may be maintained within relatively narrow limits to assure proper sheet separation, acquisition and feeding.

Figure 4:
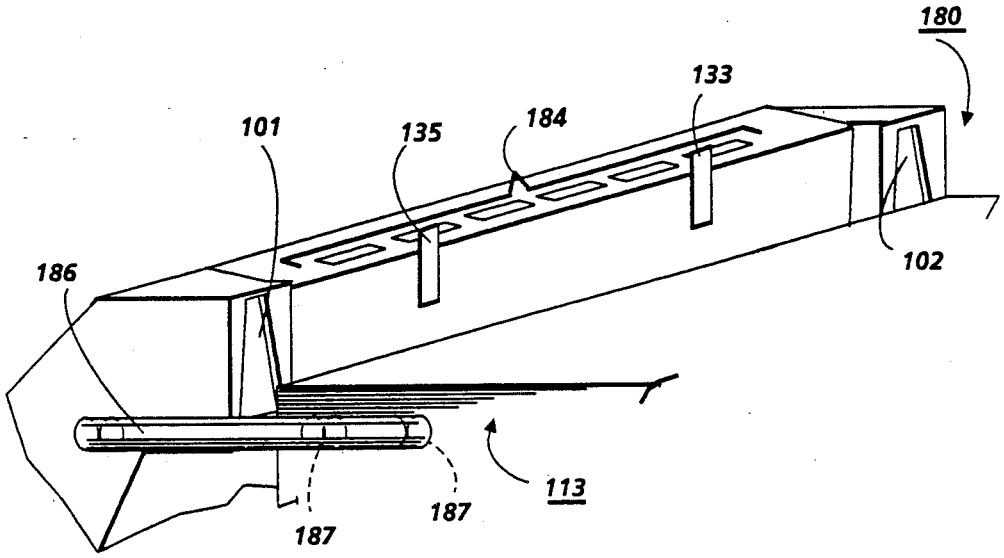
FIG. 4 is a front end view of the air knife according to the present invention.

Vacuum corrugation feeder 100 that includes a vacuum plenum 110 is positioned over a portion of and beyond the front end of a tray 40 having copy sheets 131 stacked therein. Vacuum plenum 110 has a grounded metal member 119 attached to a portion of its bottom surface that is adapted to dissipate static electricity. Belts 117 are entrained around drive roller 130 and idler roller 124 as well as plenum 110. Belts 117 could be made into a single belt if desired. Perforations 118 in the belts allow a suitable vacuum source (not shown) to apply a vacuum through plenum 110 and belts 117 to acquire sheets 131 from stack 113. The feeder uses a system of low inertia hardware, a take away jam switch 115, and a drag brake 122 to control the precise stopping position of the belts 117. The belt stopping position consistency gained with this system minimizes belt coast and as a result contributes to stopping misfeeding and shingling of sheets. Air knife 180 applies a positive pressure to the front as well as sides of stack 13 to separate the top sheet in the stack and enhance its acquisition by vacuum plenum 110. Corrugation rail 176 is attached or molded into the underside and center of plenum 110 and causes sheets acquired by the vacuum plenum to bend during their corrugation so that if a second sheet is still sticking to the sheet having been acquired by the vacuum plenum, the corrugation will cause the second sheet to detack and separate from the top sheet. A sheet captured on belts 117 is forwarded through baffles 126 and 129 into forwarding drive roller 125 and idler rollers 127 and 128 for transport to transfer station 48. In order to prevent multifeeding from tray 40, a pair of restriction members 133 and 135 are attached to the upper front end of air knife 180 and serve to inhibit all sheets other than sheet 1 from leaving the tray and is especially useful in inhibiting multifeeding of heavy weight sheets. It is also possible to place these restriction members or fangs on the tray instead of the air knife. As shown in FIG. 4, Air knife 180 has at least one tap line 186 from positive pressure chamber 185 that leads to side fluffer jets 187 on at least one side of the stack. The side fluffer jets 187 assist in the acquisition of heavy weight paper. Preferably, the side fluffer jets are on both sides of the stack. The plenum geometry of air knife 180 as shown in FIG. 3 produces a laminar flow out of the system as shown by the arrows in FIG. 3. The plenum geometry induces uniform pressure distribution from the pre-acquisition separation jets, and a stable flow field form the separation jets as will be described with reference to FIGS. 4–7 hereinafter. As seen in FIG. 3, air pressure in plenum 183 is directed against interior walls, some of which are at angles that interfere with the air flow, before exiting the knife. Upon exiting the air knife, the air is directed against the bottom of the feedhead of the vacuum corrugation feeder with a portion of the air being deflected by the feedhead toward and away from the stack of sheets in tray 40 with the portion of the air deflected toward the stack serving to fluff the top sheets in the stack and separate sheet one from sheet two, etc. A damper member 160 which is rotatable about pivot member 162 controls air leakage from the stack sides as well as controls the level of instability when 13# and 16# paper is fed. Damper member 160 which lights due to gravity lightly against the top of the sheet stack 13 stops sheets from fluttering which could cause multifeeds. The damper member is also useful when feeding curled sheets.

In order to improve sheet acquisition, increase reliability and decrease minimum feed speed vacuum plenum 110 is preferably equipped with a negative pressure source that is ON continuously during the feed cycle, with the only criteria for sheet feeding being that the motion of vacuum feedhead 170 is ceased prior to the trail edge of the acquired sheet exposing all of the vacuum ports. The next sheet is then acquired in a "traveling wave" fashion as shown in FIG. 2. This improved feeding scheme affords a reduction in cost as well as noise due to the elimination of the valve associated with cutting the vacuum means ON and OFF. Also, increased reliability/decreased minimum feed speed is obtained, i.e., for given minimum required sheet acquisition and separation time per feed cycle and/or lower required minimum feed speeds. In addition, the removal of the valve from the vacuum system increases component reliability since no valve required in the vacuum system the required valve component input/output is eliminated. It should be understood that the valveless vacuum feedhead is equally adaptable to either bottom or to vacuum corrugation feeders. If one desired, the negative pressure source could be valved, however, in this situation the vacuum valve is turned OFF as soon as the feed sheet arrives at the take away roll and is then turned back ON when the trial edges of the feed sheet passes the lead edge of the stack.

As can be seen in FIG. 2, the ripple in sheet 2 makes for a more reliable feeder since the concavity of the sheet caused by continuously operating vacuum plenum 117 will increase the unbuckling of sheet 3 from sheet 2. Sheet 3 will have a channe to settle down against the stack before sheet 2 is fed since air knife 180 has been turned off. Belts 117 are stopped just before sheet 1 uncovers the vacuum plenum completely in order to not impart a drive to sheet 2 and drive it against restriction members 133 and 135. When a signal is received from a conventional controller "C" to feed another sheet, belts 117 are turned in a clockwise direction to feed sheet 2. Air knife 180 is also turned ON and applies air pressure to the front of the stack to insure separation of sheet 2 from any other sheets and assist the vacuum plenum in lifting the front end of the sheet up against corrugation rail 176 which is an additional means of insuring against multi-sheet feeding. Air knife 80 may be either left continuously "ON" or valved "ON" and "OFF" during appropriate times in the feed cycle. Lightweight flimsy sheet feeding is enhanced with this method of feeding since sheet 2 is easily adhered to the vacuum plenum while sheet 1 is being fed by transport rollers 125, 127 and 128. Also, gravity will conform the front and rear portions of sheet 2 against the stack while the concavity produced in the sheet by the vacuum plenum remains.

Figure 9:
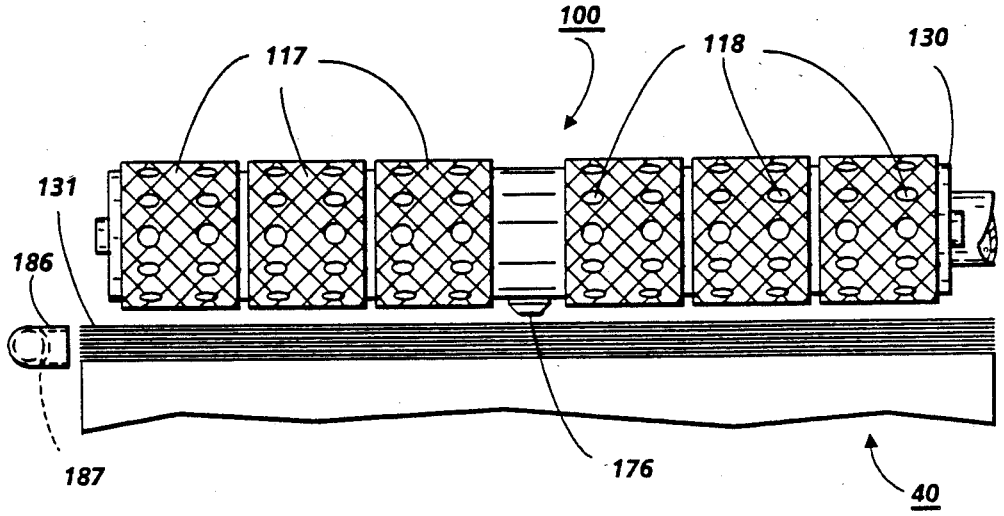
FIG. 9 is a partial front end view of the tray and feedhead of the feeder of FIG. 1.
Figure 5:
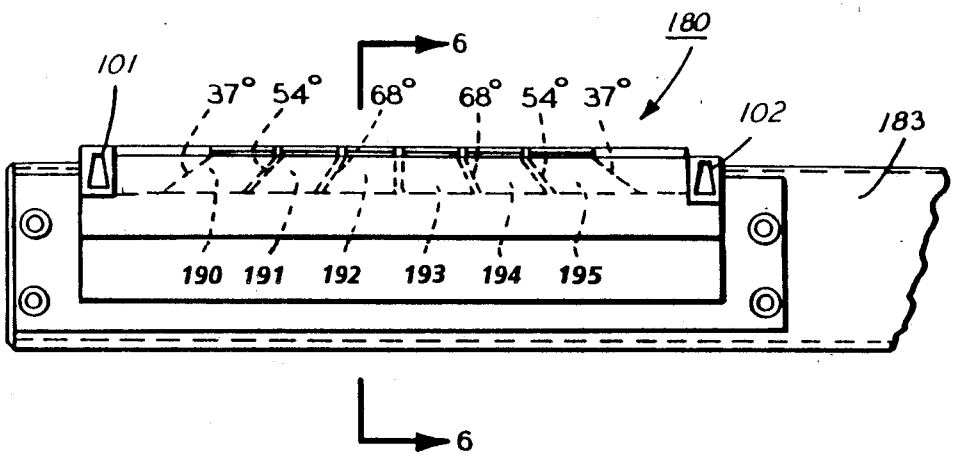
FIG. 5 is a partial front end view of the air knife of FIG. 3.
Figure 6:
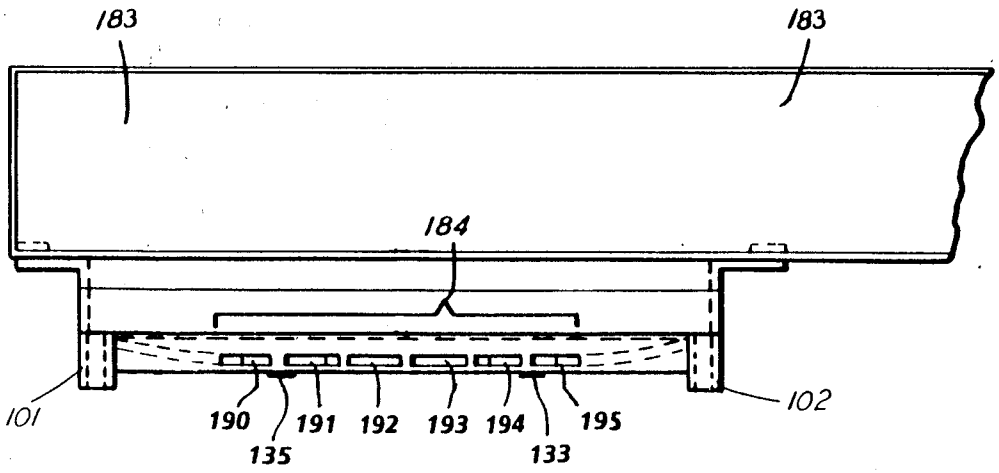
FIG. 6 is a sectional plan view of the air knife shown in FIG. 4.
Figure 7:
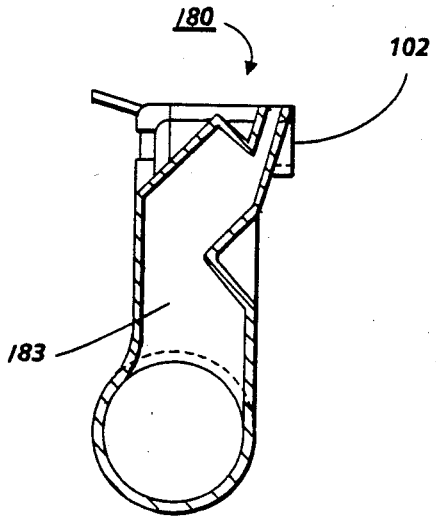
FIG. 7 is a side view of the air knife shown in FIG. 4 taken along line 6—6 of FIG. 4.

Referring more particularly to FIG. 9, there is disclosed a plurality of feed belts 117 supported for movement on rollers. Spaced within the run of belts 117 is a vacuum plenum 110 having an opening therein adapted for cooperation with perforations 118 in the belts to provide a vacuum for pulling the top sheet in the stack onto the belts 117. The plenum is provided with a centrally located projecting portion 176 so that upon capture of the top sheet in the stack by the belts a corrugation will be produced in the sheet. Thus, the sheet is corrugated in a double valley configuration. The flat surfaces of the vacuum belts on each side of the projecting portion of the vacuum plenum generates a region of maximum stress in the sheet which, varies with the beam strength of the sheet. In the unlikely event more than one sheet is pulled to the belts, the second sheet resists the corrugation action, thus gaps are opened between sheets 1 and 2 which extend to their lead edges. The gaps and channels reduce the vacuum levels between sheets 1 and 2 due to porosity in sheet 1 and provide for entry of the separating air flow of the air knife 80.

By suitable valving and controls, it is desirable to provide a delay between the time the vacuum is applied to pull the document up to the feed belts and the start up of the belts to assure that the top sheet in the stack is captured before belt movement commences and to allow time for the air knife to separate sheet 1 from sheet 2 or any other sheets that were pulled up.

Normally, vacuum feed belts and transport belts are flat, smooth usually elastomeric, and usually with prepunched holes. These holes, coupled with openings to a vacuum plenum between the belts, serve to transmit a negative pressure to the transported sheet material. This negative pressure causes a normal force to exist between the sheet material and the transport belts with the drive force between the sheet material and belts being proportional to the normal force. The problem with these conventional belts is that the negative pressure field is not uniform between the sheet material and the belts once the sheet material is acquired due to sheet porosity effects. The pressure is very highly negative (sealed post pressure) in the near regions of vacuum holes in the belts but increases quickly to atmospheric pressure as the immediate areas of holes is left. This effect reduces the average pressure differential seen by the sheet materials, thereby reducing the drive force. As can be seen from FIG. 3, belts 117 improves the coupling between the sheet materials and the vacuum belts by roughening or knurling the elastomer surface of the belts. As a result, a more uniform vacuum force is applied over the entire sheet area compared to the force localized to the regions of the belt holes with a smooth belt. In effect, roughening the surface of the belts, and using a diamond knurl pattern, allows a more uniform, higher average pressure differential to exist across the sheet material for the same heretofore used sealed port pressure, which increases the drive force. Use of a 0.30" (30 mil) diameter diamond knurl pattern on belts 117 allows 2–3X increase in available drive force for the same sealed port pressure than a conventional flat drive belt. The diamond shaped knurl pattern on belts 117 is also critical because it presents multiple sharp tips that serve to increase direct contact and friction with the sheet material and increase tacking power between the sheet material and belts by allowing the vacuum to flow between the knurls and along the diamond shaped sides of the knurls.

Figure 8A:
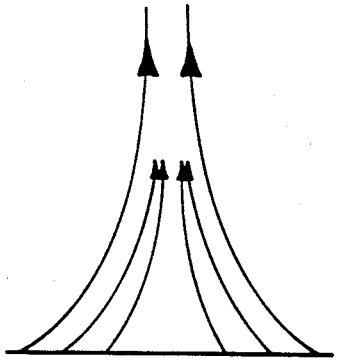
FIGS. 8A and 8B are respective plan and side view illustrations of the converging stream (FIG. 8A) and expanding air streams (FIG. 8B) which result from converging air nozzles in the air knife of FIG. 4.
Figure 8B:
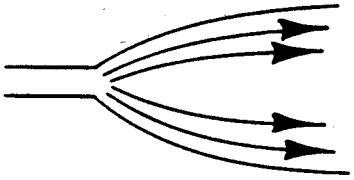

The improved air knife 180 shown in greater detail in FIGS. 3–6 contains trapezoidal shaped fluffer jets 101 and 102, and a converging slot jet 184. The pressurized air plenum 183 and converging slot jet 184 includes an array of separated air nozzled 190–195 that are angled upward with respect to the front edge of the sheet stack. The center two nozzles 192 and 193 essentially direct air streams in slightly inwardly directed parallel air streams while the two end sets of nozzles 190, 191 and 194, 195 are angled toward the center of the parallel air streams of nozzles 192 and 193 and provide converging streams of air. Typically, the end nozzles 190 and 191 are slanted at angles of 37 and 54 degrees, respectively. The same holds true for nozzles 194 and 195, that is, nozzle 194 at 54 degrees and nozzle 195 at 37 degrees are slanted inward toward the center of the nozzle group. Nozzles 192 and 193 are angled to direct the main air stream at an angle of 68 degrees respectively. Nozzles 190 through 195 are all arranged in a plane so that the air stream which emerges from the nozzles is essentially planar. As the streams produced from nozzles 190 through 195 emerges from the ends of the nozzles they tend to converge laterally toward the center of the nozzle grouping. This may be more graphically illustrated in FIG. 8A which shows the streams converging laterally. With this contraction of the air stream and the plane of the air stream, there must be an expansion in the direction perpendicular to the air stream. Stated in another manner, while the air stream converges essentially horizontally in an inclined plane, it expands vertically which is graphically illustrated in the side view of the air stream of FIG. 8A which is shown in FIG. 8B. If the air knife is positioned such that the lateral convergence of the air stream and the vertical expansion of the air stream occurs at the center of the lead edge of a stack of sheets and particularly in between the sheet to be separated and the rest of the stack, the vertical pressure between the sheet and the rest of the stack, greatly facilitates separation of the sheet from the remainder of the stack. It has been found that pre-separating sheets from one another ("fluffing") in a stack is essential in the obtainment of suitable feeding reliability for high volume feeders. Stress cases, such as downcurled stiff sheets, however, show a large resistance to "fluffing" when acted upon by sheet separation jets which are essentially perpendicular to the stack lead edge and have a circular cross section. A cure to this resistance to "fluffing" is incorporated into air knife 180 such that the reliability is greatly enhanced in addition to "fluffing" of the sheets being accomplished and this is by including trapezoidal fluffer jets at a prescribed poition with reference to the stack lead edge. These fluffer jets 101 and 102 are critical in the proper feeding of stressful paper for feeding high stacks of highly stressful materials. The trapezoidal shaped fluffer jets are adapted to create a reduced pressure toward the top of the stack in order to diminish the raising of slugs of unfluffed sheets to the feedhead. The trapezoidal shape of the fluffer jets 101 and 102 allows the greater force to be available at the bottom of the stack where it is needed the most, while the top fluffing area has less force to lift slugs of sheets into the feedhead.

It should now be apparent that the separation capability of the vacuum corrugation feeder disclosed herein is highly sensitive to air knife pressure against a sheet stack as well as the amount of vacuum pressure directed against the top sheet in the stack. Disclosed herein is a vacuum corrugation feeder that includes a unique air knife assembly that includes an elastomeric fang gate that aids in multifeed prevention, a feedhead assembly that consists of a vacuum plenum combined with knurled feed belts and a sheet corrugator. Included also is a rotational damper member that aids in feeding curled sheets and reduces sheet flutter that might contribute to multifeeds, and a valveless system that reduces overall cost of the system and improves overall sheet acquisition time, plus elimination of known reliability problems associated with valves and solenoids. Operation of the vacuum plenum such that it is ON all the time without valving allows faster throughput of copy sheets or documents through the apparatus. A belt coast control means assist in precise stopping of feed-belts and thereby contributes to a reduction in multifeeding of sheets.

In addition to the method and apparatus disclosed above, other modifications and/or additions will readily appear to those skilled in the art upon reading this disclosure and are intended to be encompassed within the invention disclosed and claimed herein.

What is claimed is:

1. In a top sheet feeding apparatus comprising a sheet stack support tray, feedhead means including a vacuum chamber positioned over the front of a stack of sheets when sheets are placed in the tray with the vacuum chamber having a negative pressure applied thereto at all times during a feed cycle, said vacuum chamber having a sheet corrugation means mounted in about the center of its bottom surface and perforated knurled feed belts associated with said vacuum chamber to transport the sheets acquired by said vacuum chamber in a forward direction out of the stack support tray; air knife means positioned immediately adjacent the front of said stack of sheets for applying a positive pressure to the sheet stack in order to separate the upper-most sheet from the rest of the stack, said air knife means including trapezoidal shaped pre-separation fluffer jets, converging slot jets, and fang gate means adapted to prevent multifeeding of sheets from the sheet stack, rotational damper means for controlling leakage from the stack sides in order to minimize sheet flutter and improve curled sheet feeding; the improvement characterized by belt coast control means for controlling the precise stopping position of said vacuum belt means in order to minimize multifeeding of sheets from the stack; and wherein said vacuum chamber includes static electricity dissipation means.

2. The improvement of claim 1, wherein said static electricity dissipation means comprises a metal plate.

3. The improvement of claim 2, including side fluffer jets positioned on at least one side of the stack in order to assist in feeding heavy weight sheets.

4. The improvement of claim 3, wherein said air knife means includes an exit path through which positive air pressure travels toward said trapezoidal shaped pre-separation fluffer jets, side fluffer jets and converging slot jets, said air knife means includes interior walls that are angled with respect to said exit path so as to interfere with the flow of said positive air pressure before it exits said air knife in order to present a laminar flow out of said air knife.

* * * * *